US011201004B1

(12) United States Patent
Farkas et al.

(10) Patent No.: US 11,201,004 B1
(45) Date of Patent: Dec. 14, 2021

(54) WIRE WITH UNEQUAL DIMENSIONS FOR CABLES IN INFORMATION HANDLING SYSTEMS

(71) Applicant: Dell Products L.P., Round Rock, TX (US)

(72) Inventors: Sandor Farkas, Round Rock, TX (US); Bhyrav Murthy Mutnury, Austin, TX (US)

(73) Assignee: DELL PRODUCTS L.P., Round Rock, TX (US)

( * ) Notice: Subject to any disclaimer, the term of this patent is extended or adjusted under 35 U.S.C. 154(b) by 0 days.

(21) Appl. No.: 17/101,343

(22) Filed: Nov. 23, 2020

(51) Int. Cl.
*H01B 11/10* (2006.01)
*H01R 13/6591* (2011.01)
*H01B 7/18* (2006.01)

(52) U.S. Cl.
CPC ..... *H01B 11/1091* (2013.01); *H01B 7/184* (2013.01); *H01R 13/65915* (2020.08)

(58) Field of Classification Search
CPC ... H01B 11/1091; H01B 11/002; H01B 11/02; H01B 11/04; H01B 11/06; H01R 13/65915
See application file for complete search history.

(56) References Cited

U.S. PATENT DOCUMENTS

2010/0294557 A1* 11/2010 Cases ..... H01B 11/203 174/350
2011/0100682 A1* 5/2011 Nonen ..... H01B 11/203 174/254
2013/0168149 A1* 7/2013 Gundel ..... H01B 7/0045 174/350
2014/0090883 A1* 4/2014 Gundel ..... H01B 11/1891 174/350
2018/0102204 A1* 4/2018 Li ..... H01B 11/1808
2021/0012928 A1* 1/2021 Kobayashi ..... H01B 7/1875

* cited by examiner

*Primary Examiner* — Hoa C Nguyen
*Assistant Examiner* — Amol H Patel
(74) *Attorney, Agent, or Firm* — Norton Rose Fulbright US LLP

(57) ABSTRACT

A cable of an information handling system may include a first signal wire, a first drain wire, and a plastic sheath enclosing a volume having at least the first signal wire. To reduce mechanical stress on the cable and the drain wire, the drain wire has a ratio of length along a first axis and along a second axis perpendicular to the first axis that is not equal to one. When bending a cable away from a first axis parallel to the cable's thickness defined as the longest dimension or towards a second axis that is perpendicular to the first axis, the top surface of the wire in the bend undergoes tensile stress and the bottom surface undergoes compression stress, and the non-equal lengths along the two axis reduce the effect of the compression and tensile stresses.

20 Claims, 7 Drawing Sheets

WIRE WITH UNEQUAL DIMENSIONS FOR CABLES IN INFORMATION HANDLING SYSTEMS

FIELD OF THE DISCLOSURE

The instant disclosure relates to cables for an information handling system. More specifically, portions of this disclosure relate to reducing conductor failure in cables under mechanical stress.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems use cables to facilitate communication and transmission between components. Communication and transmission requirements for the cables have increased as systems require higher signal speeds. The higher signal speeds increase the sensitivity of electrical performance and signal integrity to mechanical damage of the cables. The bending, rotating, folding, or long-term flexing of the cables may cause hardware failures including, but not limited to, cracking in wires in the cables. Conventionally, the installation of the cables is modified to reduce stresses applied to the cables and reduce possible failures. However, these modifications have been insufficient for reducing the stress effects on the drain wires.

Shortcomings mentioned here are only representative and are included to highlight problems that the inventors have identified with respect to existing cables in information handling systems (IHSs) and sought to improve upon. Aspects of cables with one or more features described below may address some or all of the shortcomings as well as others known in the art.

SUMMARY

A cable with one or more drain wires having a shape with different dimensions along different axes may reduce stresses on the cable when the cable is bent, such as during installation of the cable in an information handling system. The wire may have a ratio of length along a first axis and along a different second axis that is not equal to one, which reduces bending stress on the wire. In some embodiments, the ratios may be different among two perpendicular axis, such as to form a rectangular or oval shape. When bending a cable, the surface of the cable on an inner surface of the bend undergoes compression stress and the surface of the cable on an outer side of the bend undergoes tensile stress. Wires that have non-equal dimensions may balance and/or reduce the differences between the tensile stress and compression stress on opposing sides of the wire, thereby better withstanding bending stress and other factors. Wires with different dimensions along different axis may have lower rates of failure from mechanical failures such as cracking. In some embodiments, the wire shape may be applied to a drain wire, and the non-uniform drain wire may be enclosed in a protective sheath to form a ribbon cable for an information handling system.

The wire configurations described herein reduce material thickness in at least one possible direction of a bend of the wire. The wire still provides sufficient conductive material to convey signals with desired impedance and signal levels by providing thicker conductor in a direction different from a bend. The material along the thicker dimension provides limited impact on stresses of the wire during bending. Thus, the wire shape described herein reduce material thickness from the neutral plane and reduce the difference between tensile and compression stresses. These configurations may reduce cracks and other physical damage to the wire resulting from bending of the wire.

Cables with a non-unity ratio of dimensions on different axes, such as different dimensions along different radial directions for a non-circular shape, may withstand bending stress, prevent hardware failures, and limit losses in signal integrity as the cables are bent, rotated, folded, or flexed. With reliable hardware to reduce the impact of stress effects and other factors, the electrical performance and the signal integrity of cables with enhanced drain wires may improve deployment and/or operation of the cables. For example, the cables may be less likely to fail during connecting of components in the building of an information handling system, which may lead to reduced building costs and reduced on-site repairs following delivery of the information handling system.

In certain embodiments, drain wires may be rectangular, radial, or helically twisted. In certain embodiments, an insulator may enclose the drain wires for improved performance reliability. An insulator may protect the drain wires because an insulator may act as a cushion reducing the bending stress. In certain embodiments, the cable or apparatus may include a conductive shield enclosing the drain wires, which may provide additional protection from the bending stress. In another embodiment, the cable or apparatus may include a first signal wire, a first drain wire, a second signal wire, and a second drain wire for a first wire pair similar to a dual-axial cable with enhanced drain wires.

According to some embodiments of the disclosure, an apparatus includes a first signal wire, a first drain wire, wherein the first drain wire has a ratio along a first axis and along a second axis perpendicular to the first axis that is not equal to one; and the apparatus further includes a plastic sheath enclosing a volume comprising at least the first signal wire. In certain embodiments, the first drain wire may rectangular, radial, or a helical twist. In certain embodiments, the first drain wire may be enclosed in a conductive shield to provide additional protection. In another embodiment, the first drain wire may be enclosed in an insulator. In certain embodiments, the apparatus may include the first signal wire, a second signal wire, the first drain wire, and a first drain wire comprising the first wire pair, which may be configured with a second wire pair to transmit data.

According to some embodiments of the disclosure, a method to produce a cable or apparatus may comprise enclosing a first signal wire in an insulator, enclosing the first signal wire in a conductive shield, and enclosing the first signal wire and a first drain wire, wherein the first drain wire has a ratio length along a first axis and along a second axis perpendicular to the first axis that is not equal to one, in a plastic sheathing. In some embodiments, the method may further comprise forming the first drain wire into a rectangular or radial shape. In certain embodiments, the method may further comprise rotating the cable or apparatus with the first signal wire and the first drain wire into a helix to reduce stiffness in the cable or apparatus before applying the plastic sheath. In another embodiment, the method may further comprise folding the cable or apparatus away from axis parallel to the cable's thickness or towards the second axis for reducing the differences between the compression stress and tensile stress throughout the drain wires in the cables. Cables with enhanced drain wires that can bend, rotate, fold, or flex reducing the impact of bending stress during deployment and/or operations may be more reliable and improve electrical performance of the drain wires and signal integrity of the cables. For additional protection for the drain wires, certain embodiments disclose a method for enclosing the first drain wire in a conductive shield. According to another embodiment, a method may further comprise enclosing the first drain wire in an insulator. In certain embodiments, the method may further comprise producing a first wire pair by combining a second signal wire in an insulator and a conductive shield and a second drain wire, wherein the drain wires have a ratio of length along a first axis and along a second axis perpendicular to the first axis that is not equal to one, enclosed in a plastic sheath. In another embodiment, the method may comprise a second wire pair that is configured to transmit data in parallel with the first wire pair and coupled to a data input/output interface such as a PCB or paddleboard. Implementing the enhanced drain wires with a ratio not equal to one as defined in the embodiments may improve electrical performance of conventional drain wires and the signal integrity of the conventional cables that weaken or fail during deployment and/or operation due to bending, rotating, folding, or flexing.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. For example, the enhanced drain wires may be implemented in any of the embodiments of the disclosure, and the ratio length along a first axis and along a second axis perpendicular to the first axis that is not equal to one may be oriented differently depending on bending direction and thickness of the drain wires. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed cables, apparatuses, and methods, reference is now made to the following descriptions taken in conjunction with the accompanying drawings.

DETAILED DESCRIPTION

When systems communicate or transmit signals or data through wires or cables housing wires, deployment and/or operations may involve bending, rotating, folding, and/or flexing of the cables with one or more drain wires to account for physical dimensions or thermal airflow. Wire shapes described in embodiments of this disclosure may reduce bending stress and prevent hardware failures. For example, a drain wires with ratio of length along a first axis and along a second axis perpendicular to the first axis that is not equal to one may reduce stresses resulting from bending, rotating, folding, and/or flexing the cables. The reduces stresses may result in improved electrical performance, such as improved signal integrity of transmissions through the cables. Cables may be connected to components of an information handling system through termination devices, such as printed circuit boards (PCBs) or paddleboards.

Figure 1:
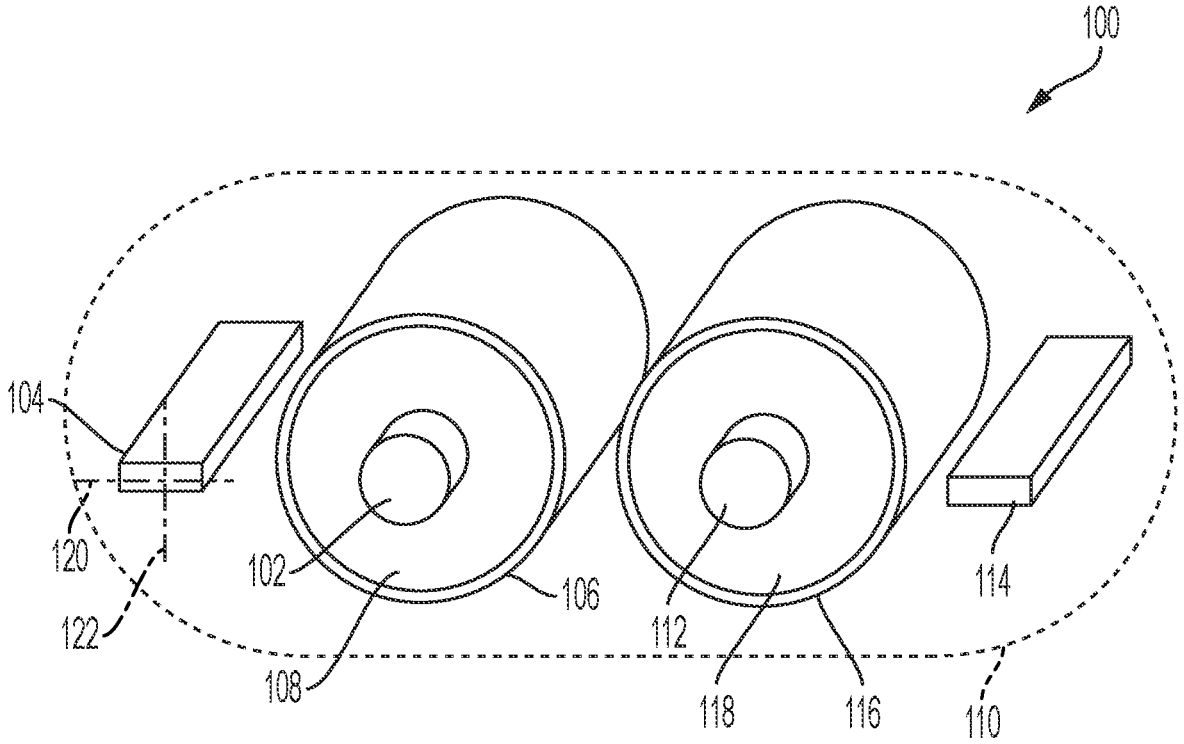
FIG. 1 is an illustration of a cable or apparatus configuration with two signal wires, insulators enclosing the signal wires, conductive shields enclosing the signal wires, and two drain wires according to some embodiments of the disclosure.

FIG. 1 illustrates a cable 100 according to some embodiments of this disclosure having a first signal wire 102, a second signal wire 112, a first drain wire 104, and a second drain wire 114 in sheathing 110. The drain wires 104 and 114 may have a ratio of length along a first axis 120 and along a second axis 122 perpendicular to the first axis 120 that is not equal to one. Example ratios for the lengths along the first axis 120 and second axis 122 include ratios between 1.0-10.0, or more particularly between 5.0-10.0, and, in some embodiments, a thickness of between 1-10 mils, or more particularly between 1-3 mils. In some embodiments, the cable 100 may include drain wires 104 and 114 of approximately 1-3 mils in thickness along the shorter axis, while providing similar impedance and other signal qualities as a conventional drain wire of approximately 11-12 mils. Each of the drain wires 104 and 114 may be described as having a non-unity aspect ratio between dimensions along the first axis 120 and second axis 122 or as having non-equal dimensions between the first axis 120 and second axis 122. The drain wires 104 and 114 and corresponding signal wires 102 and 112 may form a first wire pair 100 for carrying differential signals, with the wires 102 and 104 carrying a first signal and the wires 112 and 114 carrying a corresponding inverted signal. In some embodiments, the first wire pair 100 may be configured in cable 100 with a second wire pair to transmit data in parallel. In some embodiments, the cable 100 may be extended to include a plurality of wire pairs, such as N wire pairs, to create an N-bit wide signal interface. In some embodiments, the first wire pair 100 may be used to carry data in parallel on the signal wires 102 and 112.

The cable 100 may include other features that reduce the effects of bending, folding, or other mechanical stresses on the cable 100. For some embodiments, an insulator 108 and 118 may enclose the first signal wire 102 and the second signal wire 112, respectively. In some embodiments, a conductive shield 106 and 116 may enclose a volume having at least the first signal wire 102 and the second signal wire 112, respectively. In another embodiment, the cable 100 may be configured with the first signal wire 102, the first drain wire 104, and a conductive shield 106 enclosing a volume having at least the first signal wire 102. Another configuration may include a sheathing 110 enclosing the first signal wire 102 and the first drain wire 104 or the first wire pair 100 before deployment and/or operation.

Figure 5A:
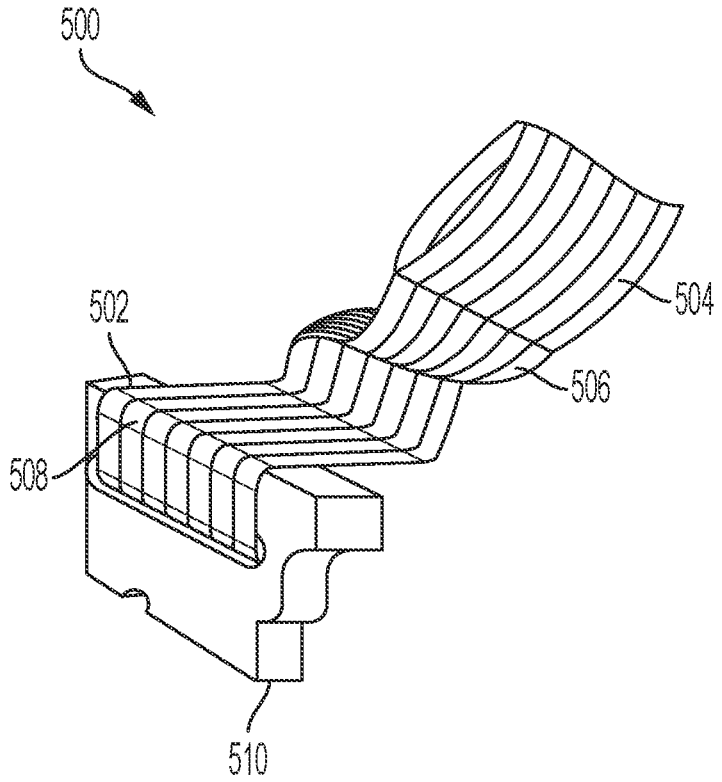
FIG. 5A is an illustration of a ribbon cable having a drain wire coupling components of an information handling system according to some embodiments of the disclosure.
Figure 5B:
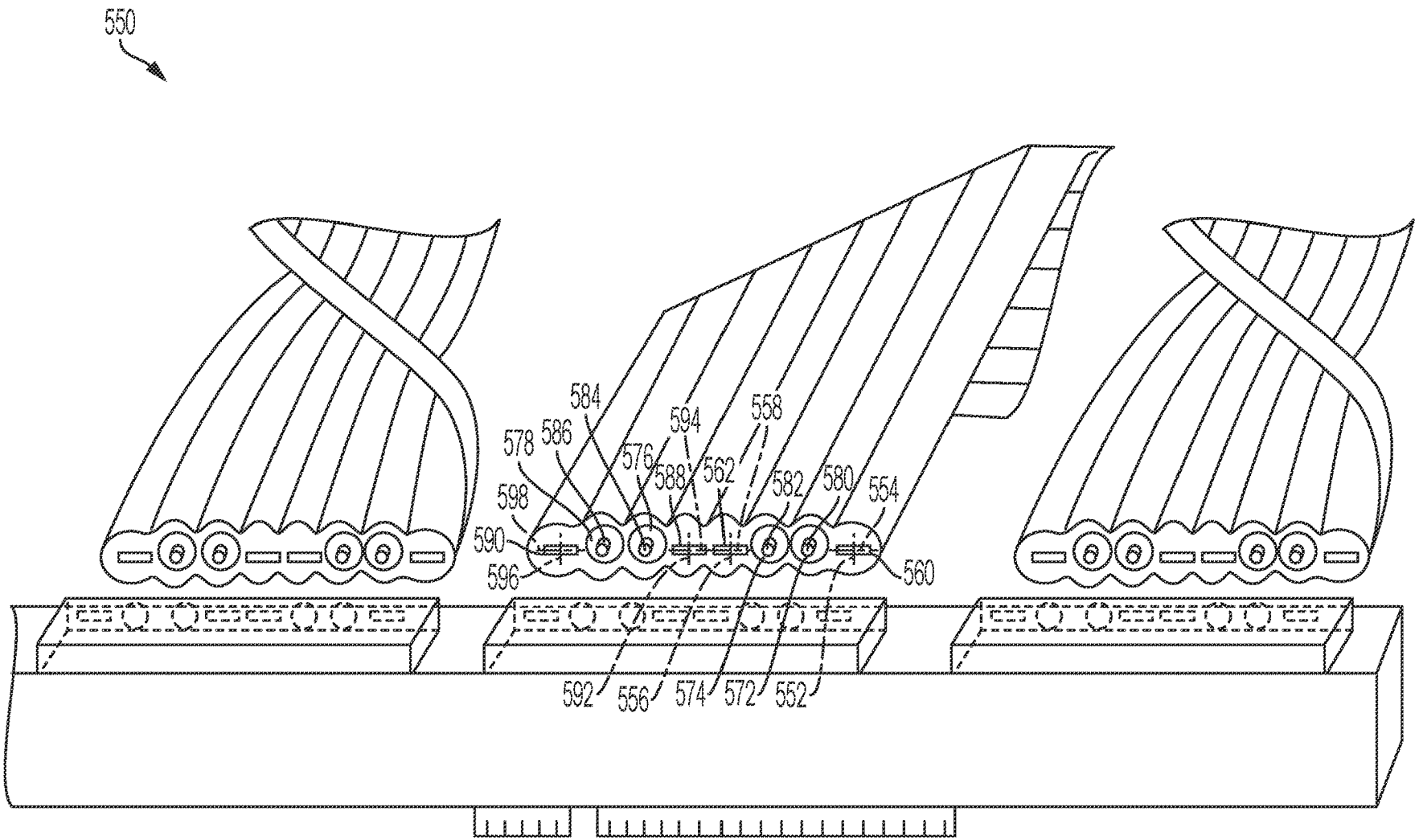
FIG. 5B is an illustration of a ribbon cable with four signal wires, insulators enclosing the signal wires, conductive shields enclosing the signal wires, and four drain wires forming two wire pairs according to some embodiments of the disclosure.
Figure 6A:
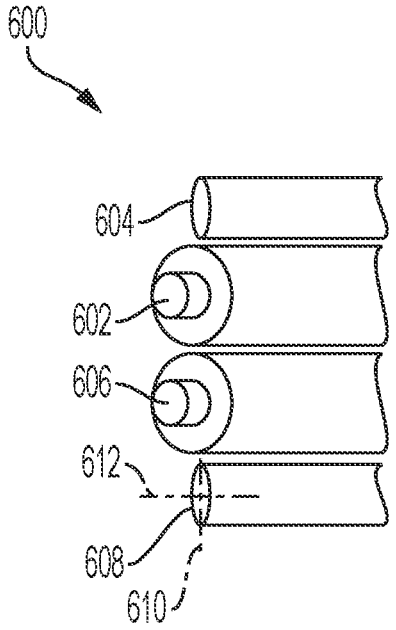
FIG. 6A is an illustration of a cable configuration with two signal wires, insulators enclosing the signal wires, conductive shields enclosing the signal wires, and two radial drain wires according to some embodiments of the disclosure.
Figure 6B:
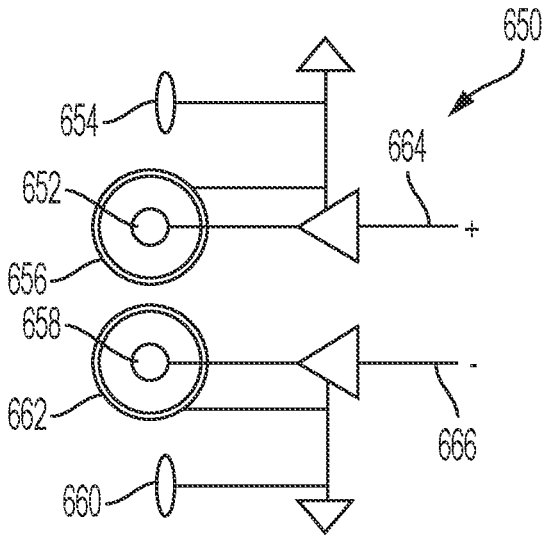
FIG. 6B is an electrical schematic of a configuration of a cable to carry differential signaling between components of an information handling system according to some embodiments of the disclosure.

Example drain wire shapes having a ratio of length along a first axis and along a second axis perpendicular to the first axis that is not equal to one include a rectangle and an oval. FIG. 1 described above illustrates one embodiment of a rectangular shape. FIGS. 6A and 6B illustrate one embodiment of a radial shape in which the shape is oval. In some embodiments, the drain wire may be twisted to randomize a direction of a neutral plane of the cable inside the sheathing 110 as shown in FIG. 2B. In some embodiments, the entire cabling, including two or more signal wires and drain wires, may be twisted in a helix as shown in FIG. 3B or folded as shown in FIG. 5A and FIG. 5B.

Figure 2A:
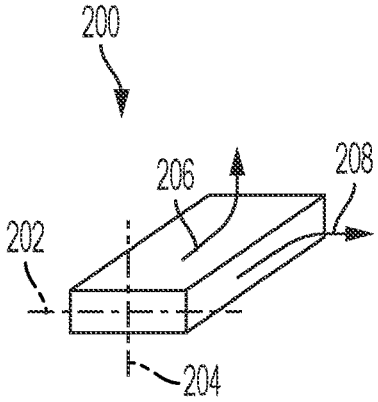
FIG. 2A is an illustration of a drain wire according to some embodiments of the disclosure.
Figure 2B:
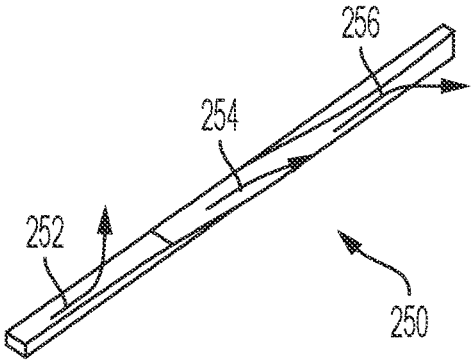
FIG. 2B is an illustration of a twisted drain wire according to some embodiments of the disclosure.

For a cable or apparatus as described in the present invention, an example drain wire 200 has a ratio of length along a first axis 202 and along a second axis 204 perpendicular to the first axis 202 that is not equal to one as shown in FIG. 2A. The length along the second axis 204 determines the severity of bending stress applied to the drain wire 200. FIG. 2A depicts two bending directions 206 and 208 and a preferred bending direction 206 along the axis 204 or around axis 202 for reducing the mechanical stress. Reducing the thickness in the direction of the bend, reduces the difference between the compression stress and tensile stress on opposite surfaces of the wire 200. The ratio of length along a first axis 202 and along a second axis 204 perpendicular to the first axis 202 that is not equal to one may be oriented differently depending on bending direction and thickness of the drain wire 200.

FIG. 2B depicts rotating the drain wire 250 with different lengths along different dimensions to provide more flexibility and durability. Drain wire 250 minimizes bending stress and prevents hardware failures such as cracking and buckling. The twisting of the drain wire 250 results in the surface parallel to the first axis to face all directions. Thus, this twisted configuration results in multiple bending directions that exhibit lower stress. The twisted drain wire 250 may be folded in any of the directions 252, 254, and 256, and in any of those directions some portion of the twisted drain wire 250 will have a first axis 202 aligned to reduce stress on the drain wire 250. For example, the drain wire 250 may be rotated towards the axis parallel to the cable's thickness towards the larger side or towards the second axis without buckling as shown in FIG. 2B.

Figure 3A:
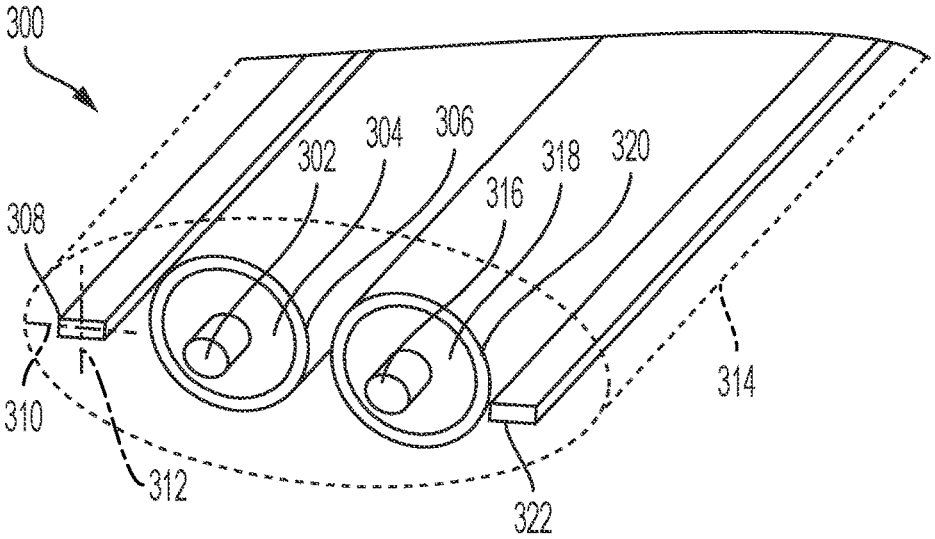
FIG. 3A is an illustration of a cable with two signal wires, insulators enclosing the signal wires, conductive shields enclosing the signal wires, and two drain wires forming a wire pair according to some embodiments of the disclosure.
Figure 3B:
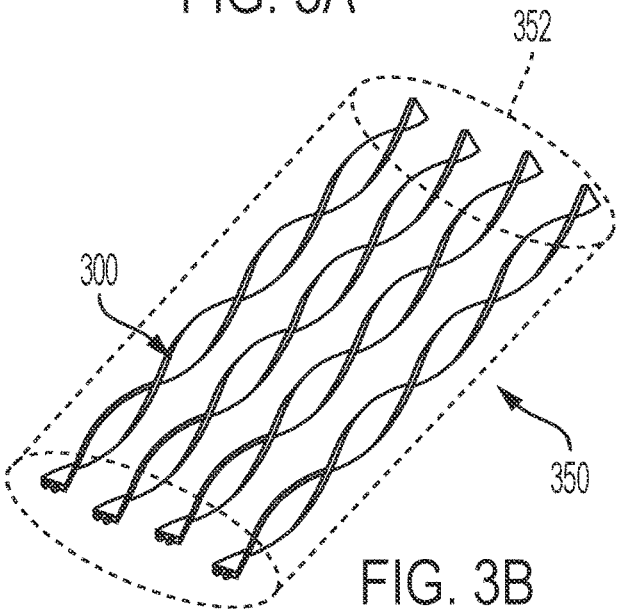
FIG. 3B is an illustration of a cable in a helical twist configuration according to some embodiments of the disclosure.

FIG. 3A and FIG. 3B are illustrations of a cable 300 and 350 configured, according to some embodiments of the disclosure, with two signal wires, insulators enclosing the signal wires, conductive shields enclosing the signal wires, and two drain wires forming a first wire pair 300. FIG. 3A depicts the cable 300 with drain wires, wherein the drain wires have a ratio of length along a first axis 310 and along a second axis 312 perpendicular to the first axis 310 that is not equal to one. Cable 300 includes a first signal wire 302 enclosed in an insulator 304; a second signal wire 316 in an insulator 318; the first signal wire 302 enclosed in a conductive shield 306; and the second signal wire 316 enclosed in a conductive shield 320. Cable 300 further includes the first drain wire 308, and a second drain wire 322, wherein the drain wires have a ratio length along a first axis 310 and along a second axis 312 perpendicular to the first axis 310 that is not equal to one, into a first wire pair 300 enclosed in a sheath 314. Each of the drain wires 308 and 322 may be described as having non-equal dimensions between the first axis 310 and second axis 312. FIG. 3B depicts the cable 350 being capable of rotating away from axis parallel to the cable's thickness or towards the second axis. The direction of rotation may impact the first wire pair 350 during deployment and/or operation if installation does not account for the bending stress applied to the drain wires, which may weaken or fail. For example, the first wire pair 350 installed may be configured to be twisted or rotated into a helix as shown in FIG. 3B before applying a sheath. In some embodiments, the wire pairs 350 may be separately twisted into a helix and enclosed in a protective sheath as shown in FIG. 3B. In some embodiments, additional sets of paired drain and signal wires may be separately twisted in a helix configuration and aligned next to each other to form a cable. Such a cable would include multiple of the helical twists shown in wire pair 350 next to each other within a protective sheathing.

Figure 4:
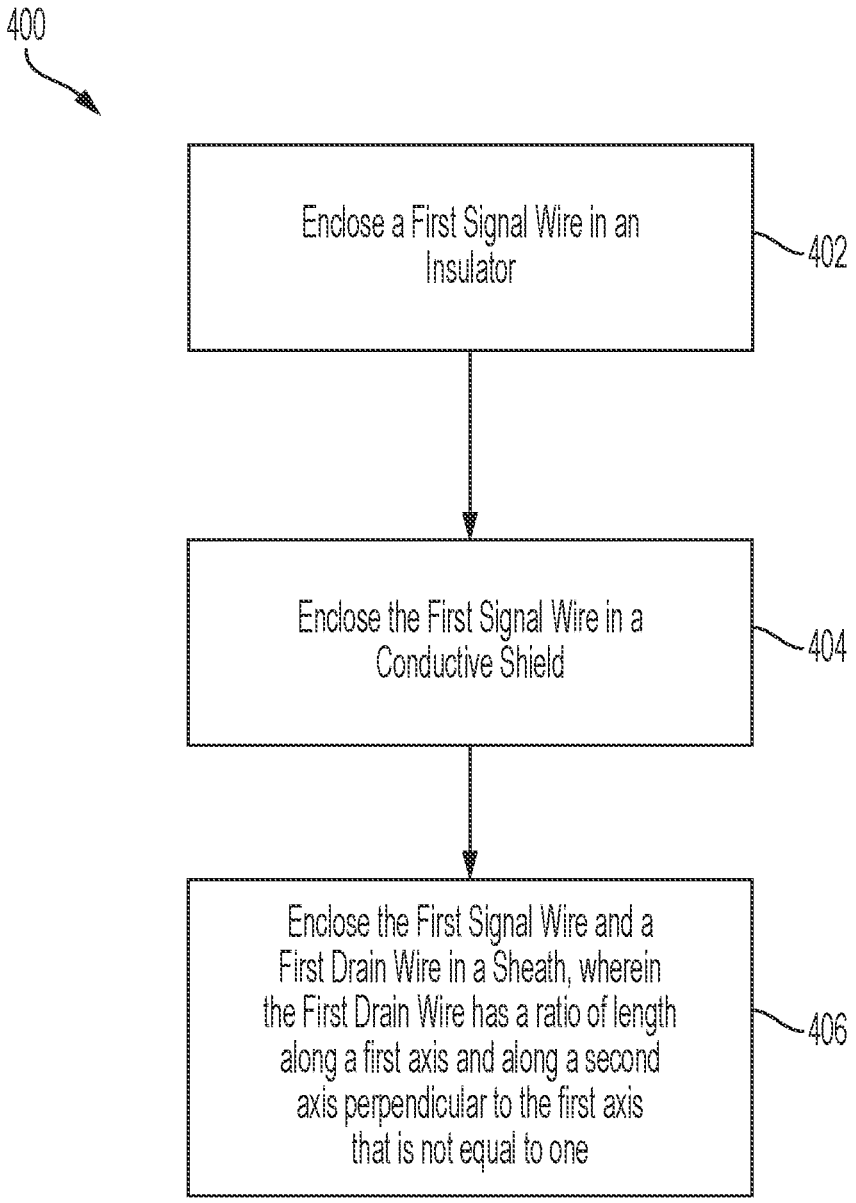
FIG. 4 is a flow chart illustrating construction of a cable with a drain wire according to some embodiments of the disclosure.

The method 400 of constructing a cable as shown in FIG. 4 includes block 402 for enclosing a first signal wire in an insulator. Method 400 may also include enclosing a second signal wire in an insulator to provide two paths for the transmission of signals or currents. For example, the first signal wire may transmit a positive signal and the second signal wire may transmit a negative signal in a differential signal.

Block 404 of method 400 involves enclosing the first signal wire in a conductive shield, and method 400 may also include enclosing the second signal wire in a conductive shield. The conductive shields may protect the first and second signal wire similar to insulators from block 402. After the cable is formed with at least one signal wire and one drain wire, the cable may be enclosed in a protective sheath.

Block 406 of method 400 involves enclosing the first signal wire and the first drain wire in the sheath, wherein the first drain wire has a ratio length along a first axis and along a second axis perpendicular to the first axis that is not equal to one. The method 400 may also include combining the first signal wire and the first drain wire with the second signal wire the second drain wire to form a first wire pair. Method 400 may also include enclosing the first wire pair in a sheathing after block 406. By way of example, and not limitation, the first wire pair may be twisted before applying the sheath reduces the stiffness in the cable 500 to ease installation of the cable 500 in tight bends or spaces as shown in FIG. 5A. Both the first drain wire and the second drain wire may be described as having non-equal dimensions between the first axis and second axis. The cable formed after block 406 may be cut into segments and rotated to form a helix as shown in FIG. 3B. The method 400 may further include configuring the first wire pair and second wire pair to transmit data in parallel; and coupling the first wire pair and the second wire pair to a data input/output interface such as a PCB or paddleboard for ease of installation.

In some embodiments, the method 400 may further include forming the first drain wire and the second drain wire into a rectangular shape as shown in FIG. 1. The shapes of the drain wires are not limited to a rectangular shape with a ratio length along a first axis and along a second axis perpendicular to the first axis that is not equal to one. In other embodiments, the method 400 may further include forming the first drain wire and the second drain wire into a radial shape such as an oval as shown in FIG. 6A and FIG. 6B. In another embodiment, the method 400 may further include rotating the first drain wire and the second drain wire into a helix away from axis parallel to the cable's thickness or towards the second axis as shown in FIG. 2B. Rotating the drain wires or the cables may reduce stiffness in the cables before the enclosing the cables in the sheathing. In some embodiments, the method 400 further includes twisting or rotating the first signal wire and the first drain wire into a helix. In other embodiments, pairs of signal and drain wires may be twisted to further improve bendability. The first signal wire, the second signal wire, the first drain wire, and the second drain wire may be rotated into a helix as the first wire pair as shown in FIG. 3B. In a helix, the neutral plane faces in all directions in a periodic or aperiodic interval, which allows the cable to be bent and turned in any direction with reduced stress. The helix may also be formed of different combinations of signal wires and drain wires. For example, the helix may include N number of signal wires and M number of drain wires, wherein N and M may be equal or not equal, and wherein N may be multiples of two. The method 400 may further include configuring the cable to be folded along a neutral axis, away from axis parallel to the cable's thickness, or towards the second axis that is oriented in a particular manner with the first drain wire and the first axis as shown in FIG. 5B.

Regarding method 400 and other embodiments disclosed, other steps and methods may be conceived that are equivalent in function, logic, or effect to one or more steps, or portions thereof, of the disclosed method. Additionally, the order in which a particular method occurs may or may not strictly adhere to the order of the correspond steps as described.

FIG. 5A and FIG. 5B are illustrations of a ribbon cable 500 and 550 according to some embodiments of the disclosure. FIG. 5A depicts an example ribbon cable 500 having a drain wire with a bend 502, a rotation 504, and a fold 506. Cable 500 may connect components of an IHS. When installing the cable 500, the cable 500 may be bent, rotated, folded, or flexed during deployment and/or operation to account for physical dimensions, thermal airflow, or other factors. The cable 500 may include one or more signal wires and drain wires to form wire pairs 508, wire pairs 508 may be configured to transmit in parallel by coupling to a data input/output interface 510 such as a PCB or paddleboard. The installed cable 500 may be folded in the preferred folding direction 206 as indicated in FIG. 2A and FIG. 2B. For example, cable 550 may folded such that a surface on the longer of the dimensions is folded towards another surface of the dimensions. By folding cable 500 and 550 in such a direction, the compressive stress from the fold may be applied along a longer axis of the first axis and the second axis of the drain wires.

FIG. 5B depicts a ribbon cable 550 with four signal wires 580, 582, 584, and 586. Cable 550 may include insulators 572, 574, 576, and 578 enclosing the signal wires 580, 582, 584, and 586. The ribbon cable 550 may also include conductive shields enclosing the signal wires 580, 582, 584, and 586. Cable 550 may further include four drain wires 560, 562, 588, and 590. A first wire pair may include a first signal wire 580, a second signal wire 582, the first drain wire 560, and the second drain wire 562 according to some embodiments of the disclosure. For example, the first drain wire 560 and the second drain wire 562 are rectangular shapes with ratio lengths along the first axis 554 and 558 and along the second axis 552 and 556 perpendicular to the first axis 554 and 558 that are not equal to one. In some embodiments, different drain wires of different shape may be included in the cable 550, such as rectangular drain wires and oval drain wires. According to some embodiments, cable 550 depicts the first wire pair coupled with a second wire pair configured with a first signal wire 584, a second signal wire 586, a first drain wire 588, and a second drain wire 590. Each of the drain wires 560, 562, 588, and 590 may be described as having non-equal dimensions between the first axis 554, 558, 594, and 598 and a respective second axis 552, 556, 592, and 596. The illustration of the cable 550 shows a fold in the cable 550 in one possible folding direction, similar to the direction 206 as indicated in FIG. 2A and FIG. 2B. Additionally, the first wire pair and the second wire pair may be configured to transmit information in parallel by coupling to a data input/output interface such as a PCB or paddleboard.

FIG. 6A and FIG. 6B are illustrations of a cable 600 and 650 configured with two signal wires, an insulator enclosing the signal wires, a conductive shield enclosing the signal wires, and two radial drain wires according to some embodiments of the disclosure. FIG. 6A depicts the cable 600 with the first signal wire 602, the second signal wire 606, the first drain wire 604, and the second drain wire 608, wherein the drain wires have a ratio of length along a first axis 610 and along a second axis 612 perpendicular to the first axis 610 that is not equal to one, forming the first wire pair 600. For example, the first drain wire 604 and the second drain wire 608 may be a radial shape a ratio of length along a first axis 610 and along a second axis 612 perpendicular to the first axis 610 that is not equal to one such as an oval. Each of the drain wires 604 and 608 may be described as having non-equal dimensions between the first axis 610 and second axis 612.

FIG. 6B depicts an electrical schematic 650 of the cable 600 components according to some embodiments of the disclosure. The electrical schematic 650 is representative of the functional components of the cable 600 as shown in FIG. 6B. A first component 664 is connected to the first signal wire 652 and a second component 666 is connected to the second signal wire 658. A first signal wire 652 and a second signal wire 658 may represent a positive and negative signal in a differential signal. Alternatively, the signal wires 652 and 658 may be used to transmit two different signals or two different currents. The first drain wire 654 and the second drain wire 660 represent grounds along with the conductive shields 656 and 662. Reliable hardware such as drain wires 654 and 660 with a ratio of length along a first axis and along a second axis perpendicular to the first axis that is not equal to one may withstand bending stress and improve electrical performance and signal integrity during deployment and/or operation in systems such as IHS.

Figure 7:
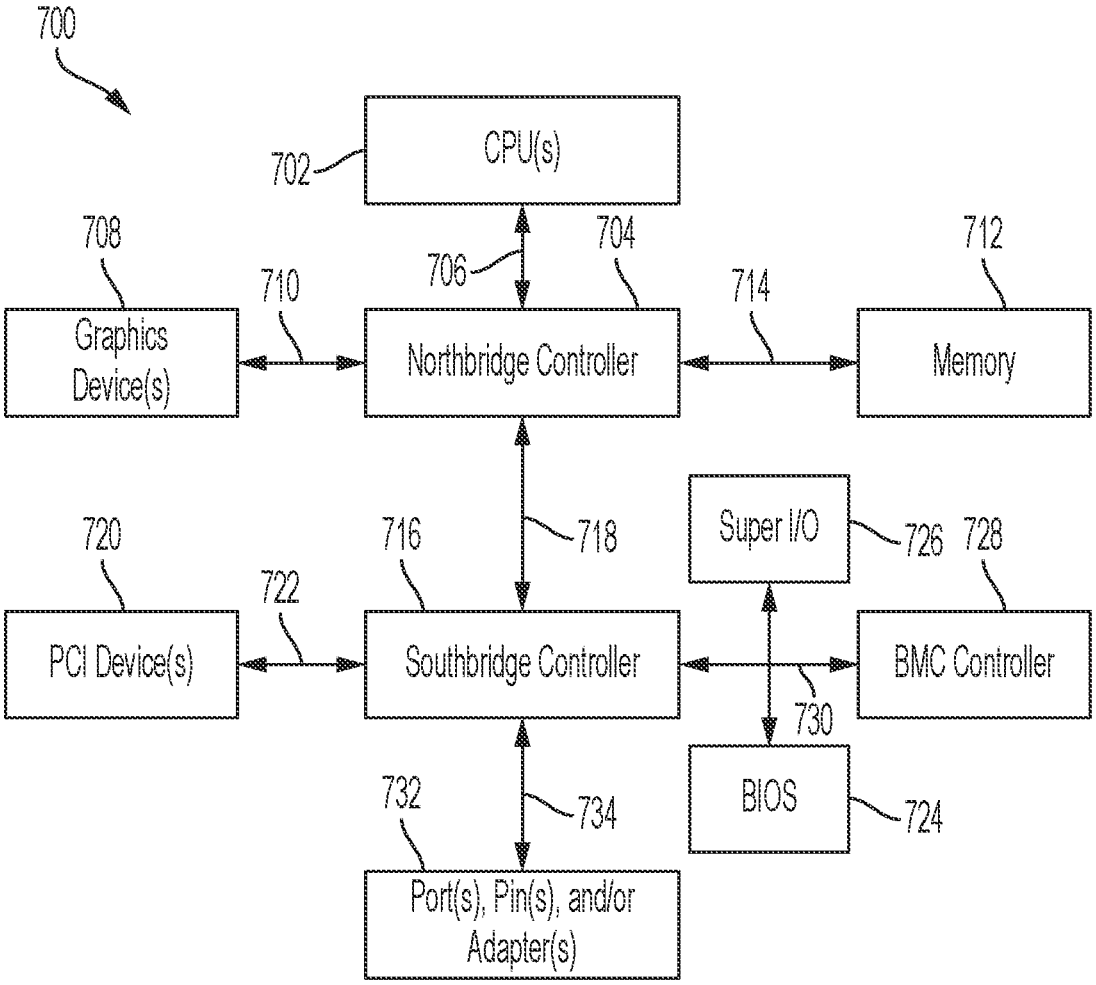
FIG. 7 is a schematic block diagram of an example information handling system according to some embodiments of the disclosure.

FIG. 7 is a schematic block diagram of an example information handling system according to some embodiments of the disclosure. An information handling system may include a variety of components to generate, process, display, manipulate, transmit, and receive information. Any of the illustrated components may be coupled to each other by a cable, such as embodiments of a cable described in this disclosure. One example of an information handling system 700 is shown in FIG. 7. IHS 700 may include one or more central processing units (CPUs) 702. In some embodiments, IHS 700 may be a single-processor system with a single CPU 702, while in other embodiments IHS 700 may be a multi-processor system including two or more CPUs 702 (e.g., two, four, eight, or any other suitable number). CPU(s) 702 may include any processor capable of executing program instructions. For example, CPU(s) 702 may be processors capable of implementing any of a variety of instruction set architectures (ISAs), such as the x86, POWERPC®, ARM®, SPARC®, or MIPS® ISAs, or any other suitable ISA. In multi-processor systems, each of CPU(s) 702 may commonly, but not necessarily, implement the same ISA.

CPU(s) 702 may be coupled to northbridge controller or chipset 704 via front-side bus 706. The front-side bus 706 may include multiple data links arranged in a set or bus configuration. Northbridge controller 704 may be configured to coordinate I/O traffic between CPU(s) 702 and other components. For example, northbridge controller 704 may be coupled to graphics device(s) 708 (e.g., one or more video cards or adaptors, etc.) via graphics bus 710 (e.g., an Accelerated Graphics Port or AGP bus, a Peripheral Component Interconnect or PCI bus, etc.). Northbridge controller 704 may also be coupled to system memory 712 via memory bus 714. Memory 712 may be configured to store program instructions and/or data accessible by CPU(s) 702. In various embodiments, memory 712 may be implemented using any suitable memory technology, such as static RAM (SRAM), synchronous dynamic RAM (SDRAM), non-volatile/Flash-type memory, or any other type of memory.

Northbridge controller 704 may be coupled to southbridge controller or chipset 716 via internal bus 718. Generally, southbridge controller 716 may be configured to handle various of IHS 700's I/O operations, and it may provide interfaces such as, for instance, Universal Serial Bus (USB), audio, serial, parallel, Ethernet, etc., via port(s), pin(s), and/or adapter(s) 732 over bus 734. For example, southbridge controller 716 may be configured to allow data to be exchanged between IHS 700 and other devices, such as other IHS s attached to a network. In various embodiments, southbridge controller 716 may support communication via wired or wireless general data networks, such as any suitable type of Ethernet network, for example; via telecommunications/telephony networks such as analog voice networks or digital fiber communications networks; via storage area networks such as Fiber Channel SANs; or via any other suitable type of network and/or protocol.

Southbridge controller 716 may also enable connection to one or more keyboards, keypads, touch screens, scanning devices, voice or optical recognition devices, or any other devices suitable for entering or retrieving data. Multiple I/O devices may be present in IHS 700. In some embodiments, I/O devices may be separate from IHS 700 and may interact with IHS 700 through a wired or wireless connection. As shown, southbridge controller 716 may be further coupled to one or more PCI devices 720 (e.g., modems, network cards, sound cards, video cards, etc.) via PCI bus 722. The PCI devices 720 may couple to other information handling systems (such as through network cabling) and electronic devices (such as through audio cabling), in which the coupling is through wires according to embodiments of this disclosure. Southbridge controller 716 may also be coupled to Basic I/O System (BIOS) 724, Super I/O Controller 726, and Baseboard Management Controller (BMC) 728 via Low Pin Count (LPC) bus 730.

BIOS 724 may include non-volatile memory having program instructions stored thereon. The instructions stored on the BIOS may be usable CPU(s) 702 to initialize and test other hardware components and/or to load an Operating System (OS) onto IHS 700, for example during a pre-boot stage. For example, BIOS may also refer to a set of instructions, stored on BIOS 724, that are executed by CPU(s) 702. As such, BIOS 724 may include a firmware interface that allows CPU(s) 702 to load and execute certain firmware, as described in more detail below. In some cases, such firmware may include program code that is compatible with the Unified Extensible Firmware Interface (UEFI) specification, although other types of firmware may be used.

BMC controller 728 may include non-volatile memory having program instructions stored thereon that are usable by CPU(s) 702 to enable remote management of IHS 700. For example, BMC controller 728 may enable a user to discover, configure, and manage BMC controller 728, setup configuration options, resolve and administer hardware or software problems, etc. Additionally or alternatively, BMC controller 728 may include one or more firmware volumes, each volume having one or more firmware files used by the BIOS' firmware interface to initialize and test components of IHS 700.

In some embodiments, IHS 700 may be configured to access different types of computer-accessible media separate from memory 712. Generally speaking, a computer-accessible medium may include any tangible, non-transitory storage media or memory media such as electronic, magnetic, or optical media—e.g., magnetic disk, a hard drive, a CD/DVD-ROM, a Flash memory, etc. coupled to IHS 700 via northbridge controller 704 and/or southbridge controller 716. Super I/O Controller 726 combines interfaces for a variety of lower bandwidth or low data rate devices. Those devices may include, for example, floppy disks, parallel ports, keyboard and mouse, temperature sensor and fan speed monitoring, etc.

In some embodiments, northbridge controller 704 may be combined with southbridge controller 716, and/or be at least partially incorporated into CPU(s) 702. In other implementations, one or more of the devices or components shown in FIG. 7 may be absent, or one or more other components may be added. Accordingly, systems and methods described herein may be implemented or executed with other computer system configurations. In some cases, various elements shown in FIG. 7 may be mounted on a motherboard, coupled to a PCB, paddleboard or other connector, or protected by a chassis or the like.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. For example, although cables with drain wires are described throughout the detailed description, aspects of the disclosure may be applied to the design of or implementation on different kinds of cables, such as flexible cables, flex cables, ribbon cables, filled cables, power cables etc. As another example, although communications and transmissions of certain signals through the cables may be described in example embodiments, other kinds or types of information may be carried through the cables depending on applications and operations performed by the information handling system using the cables. As another example, although processing of certain kinds of data may be described in example embodiments, other kinds or types of data may be processed through the methods and devices described above. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of non-volatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

What is claimed is:

1. An apparatus, comprising:

a first signal wire;

a first drain wire, wherein the first drain wire has a ratio of length along a first axis and along a second axis perpendicular to the first axis that is not equal to one; and a protective sheath enclosing a volume comprising at least the first signal wire and the first drain wire, wherein the first signal wire and the first drain wire are configured to be folded such that compressive stress is applied along a length of the first drain wire corresponding to a longer axis of the first axis and the second axis of the first drain wire.

2. The apparatus of claim 1, wherein the first drain wire is rectangular.

3. The apparatus of claim 1, wherein the first drain wire is oval.

4. The apparatus of claim 1, wherein the ratio along the first axis and the second axis is between 5-10.

5. The apparatus of claim 1, further comprising: a second signal wire; and a second drain wire.

6. The apparatus of claim 5, wherein the second signal wire, the second drain wire, the first signal wire and the first drain wire are twisted together in a helix configuration.

7. The apparatus of claim 6, wherein the first signal wire, the second signal wire, the first drain wire, and the second drain wire comprise a first wire pair, the apparatus further comprising a second wire pair, wherein the first wire pair and the second wire pair are configured to transmit data in parallel.

8. An information handling system, comprising:

a first component;

a second component; and a cable comprising:

a first signal wire;

a first drain wire, wherein the first drain wire has a ratio of length along a first axis and along a second axis perpendicular to the first axis that is not equal to one; and a protective sheath enclosing a volume comprising at least the first signal wire, wherein the first signal wire and the first drain wire are folded such that compressive stress is applied along a length of the first drain wire corresponding to a longer axis of the first axis and the second axis of the first drain wire.

9. The cable of claim 8, wherein the first drain wire is rectangular.

10. The cable of claim 8, wherein the first drain wire is oval.

11. The cable of claim 8, further comprising a conductive shield enclosing the first signal wire; and an insulator surrounding the first signal wire.

12. The cable of claim 8, further comprising: a second signal wire; and a second drain wire.

13. The cable of claim 12, wherein the second signal wire, the second drain wire, the first signal wire and the first drain wire are twisted together in a helix configuration.

14. The cable of claim 13, wherein the first signal wire, the second signal wire, the first drain wire, and the second drain wire comprise a first wire pair, the cable further comprising a second wire pair, wherein the first wire pair and the second wire pair are configured to transmit data in parallel.

15. A method, comprising:

enclosing a first signal wire in an insulator;

enclosing the first signal wire in a conductive shield; and enclosing the first signal wire and a first drain wire in a protective sheathing, wherein the first drain wire has a ratio of length along a first axis and along a second axis perpendicular to the first axis that is not equal to one and configured to be folded such that compressive stress is applied along a length of the first drain wire corresponding to a longer axis of the first axis and the second axis of the first drain wire.

16. The method of claim 15, further comprising forming the first drain wire into a rectangular shape.

17. The method of claim 15, further comprising forming the first drain wire into an oval shape.

18. The method of claim 15, further comprising:

enclosing a second signal wire in an insulator;

enclosing the second signal wire in a conductive shield; and combining, into a first wire pair, the first signal wire, the second signal wire, the first drain wire, and a second drain wire, wherein the second drain wire has a ratio of length along a third axis and along a fourth axis perpendicular to the third axis that is not equal to one, wherein the second signal wire and the second drain wire are enclosed in the sheathing with the first signal wire and the first drain wire.

19. The method of claim 18, wherein the second signal wire, the second drain wire, the first signal wire and the first drain wire are twisted together in a helix configuration.

20. The method of claim 15, further comprising rotating the first signal wire and the first drain wire in a helix configuration.

* * * * *